US012433379B2

(12) United States Patent
Di Piazza et al.

(10) Patent No.: US 12,433,379 B2
(45) Date of Patent: Oct. 7, 2025

(54) DEVICE FOR ADJUSTING THE LENGTH OF A WRISTLET

(71) Applicant: ROLEX SA, Geneva (CH)

(72) Inventors: Philippe Di Piazza, Ville-la-Grand (FR); Teddy Grivet, Segny (FR)

(73) Assignee: ROLEX SA, Geneva (CH)

( * ) Notice: Subject to any disclaimer, the term of this patent is extended or adjusted under 35 U.S.C. 154(b) by 124 days.

(21) Appl. No.: 17/865,793

(22) Filed: Jul. 15, 2022

(65) Prior Publication Data

US 2023/0030001 A1 Feb. 2, 2023

(30) Foreign Application Priority Data

Jul. 30, 2021 (EP) ..... 21188694

(51) Int. Cl.
*A44C 5/24* (2006.01)

(52) U.S. Cl.
CPC ..... *A44C 5/246* (2013.01)

(58) Field of Classification Search
CPC ..... A44C 5/246; A44C 5/243; A44C 5/24; A44C 5/22; A44C 5/2066; A44C 5/2052; A44C 5/2057; A44C 5/2061; A44C 5/2085; A44B 11/2515; A44B 11/2523; A44B 11/2534; A44B 11/258; A44B 11/266

See application file for complete search history.

(56) References Cited

U.S. PATENT DOCUMENTS 1,985,835 A * 12/1934 Prestinari ..... A44C 5/246 24/71 J
5,771,543 A * 6/1998 Froidevaux ..... A44C 5/246 24/69 J (Continued)

FOREIGN PATENT DOCUMENTS

CH 701804 A2 * 3/2011 ..... A44C 5/246
CH 716201 A2 * 11/2020 ..... A44C 5/2052

(Continued)

OTHER PUBLICATIONS

International Search Report and Written Opinion dated Jan. 11, 2022 in priority application No. EP21188694.0; with English partial translation and partial machine translation (total 10 pages).

*Primary Examiner* — Jason W San
*Assistant Examiner* — Anna S Rashid
(74) *Attorney, Agent, or Firm* — Seckel IP, PLLC

(57) ABSTRACT

A device for adjusting the length of a wristlet includes: a cover (10); a link element (40) designed to be connected to a wristlet strand (9) and mounted movable relative to the cover (10) in the longitudinal direction in which extends a wristlet strand to be connected to the adjusting link element, such that this displacement of the adjusting link element (40) relative to the cover (10) enables lengthening or shortening the length of a wristlet strand; an actuating device (30) arranged on the cover (10) movable relative to the cover in at least the longitudinal direction; and a kinematic connection connecting the actuating device (30) and the adjusting link element (40), such that the actuation of the actuating device (30) in at least the longitudinal direction relative to the cover (10) can bring about the longitudinal displacement of the adjusting link element (40) relative to the cover (10).

19 Claims, 9 Drawing Sheets

(56) References Cited

U.S. PATENT DOCUMENTS

| | | | | |
|---|---|---|---|---|
| 8,001,658 | B2 * | 8/2011 | Christian | A44C 5/246 24/71 J |
| 9,003,611 | B2 * | 4/2015 | Catanese | A44C 5/246 63/3.2 |
| 9,526,305 | B2 * | 12/2016 | Granito | A44C 5/22 |
| 9,615,634 | B2 * | 4/2017 | Kaltenrieder | A44B 17/0017 |
| 11,730,240 | B2 * | 8/2023 | Yamashita | A44C 5/246 24/615 |
| 11,903,462 | B2 * | 2/2024 | Granito | A44C 5/246 |
| 2008/0083101 | A1 * | 4/2008 | Christian | A44C 5/246 24/71 J |
| 2009/0241597 | A1 * | 10/2009 | Robert | A44C 5/246 63/3.2 |
| 2012/0110792 | A1 * | 5/2012 | Granito | A44C 5/246 24/265 EC |
| 2019/0254391 | A1 * | 8/2019 | Celant | A44C 5/246 |
| 2020/0405018 | A1 * | 12/2020 | Granito | A44C 5/246 |
| 2021/0022457 | A1 * | 1/2021 | Schaller | A44C 5/02 |
| 2021/0059363 | A1 * | 3/2021 | Celant | A44C 5/02 |
| 2023/0255327 | A1 * | 8/2023 | Garcin | A44C 5/246 63/3.2 |

FOREIGN PATENT DOCUMENTS

| | | | | |
|---|---|---|---|---|
| EP | 0819391 | A1 | 1/1998 | |
| EP | 1908366 | A1 * | 4/2008 | A44C 5/246 |
| EP | 2248437 | A1 * | 11/2010 | A44C 5/22 |
| EP | 2875747 | A1 * | 5/2015 | A44C 5/246 |
| WO | WO-2008064931 | A1 * | 6/2008 | A44C 5/246 |
| WO | WO-2011051768 | A1 * | 5/2011 | A44C 5/246 |
| WO | WO-2019158471 | A1 * | 8/2019 | A44C 5/0053 |
| WO | WO-2021240317 | A1 * | 12/2021 | A44C 5/243 |
| WO | WO-2023135470 | A1 * | 7/2023 | A44C 5/246 |

* cited by examiner

DEVICE FOR ADJUSTING THE LENGTH OF A WRISTLET

This application claims priority of European patent application No. EP21188694.0 filed Jul. 30, 2021, the content of which is hereby incorporated by reference herein in its entirety.

INTRODUCTION

The present invention relates to a device for adjusting the length of a wristlet, particularly suitable for a wristlet for a wristwatch provided with a deployment clasp fitted between two ends of the wristlet. It also relates to a clasp and to a wristlet per se, incorporating such a device for adjusting the length of a wristlet, and to a timepiece such as a wristwatch per se comprising such a device.

BACKGROUND ART

A deployment clasp from the prior art, provided to fasten the two strands of a watch wristlet around the wrist of its wearer, comprises multiple articulated blades able to occupy a first, closed position, in which the blades are folded together over one another, and a second, open position, in which the blades are no longer superposed but deployed and make it possible to put on or take off the watch. Such a clasp is generally provided with a means for adjusting the length of the wristlet or of a wristlet strand.

To that end, existing clasps are equipped with a solution that allows the length of the wristlet to be adjusted once or multiple times. By way of example, documents EP0819391, EP1908366, and WO2019158471 describe solutions for adjusting the length of a wristlet, in which an adjusting link element of the wristlet can be displaced with respect to a cover for a clasp of said wristlet. These existing solutions generally require a specific manipulation by a user, who must adequately position movable elements, when adjusting the length of the wristlet.

A general objective of the invention is to further improve the adjustability of the length of a wristlet.

More particularly, an objective of the invention is to propose a solution for adjusting the length of a wristlet, which is reliable in its operation and intuitive and convenient to manipulate. An advantage of the invention that will be described below stems in particular from the fact that the adjustment does not require the watch to be removed from the wrist.

In addition, an objective of the invention is to propose a solution for adjusting the length of a wristlet that is optimally incorporated in the wristlet or the clasp in which it is fitted, in particular for esthetic purposes.

SUMMARY OF THE INVENTION

To that end, the invention is based on a device for adjusting the length of a wristlet, in which an adjusting link element is mounted such that it can move in a longitudinal direction in relation to a cover, so as to drive one end of a wristlet strand in the sense of lengthening or shortening a wristlet, this adjusting link element being displaced by the actuation of an actuating device fitted on a surface of the cover such that it can move in said longitudinal direction and connected to the adjusting link element via a first kinematic connection.

The invention is more specifically defined by the claims.

BRIEF DESCRIPTION OF THE DRAWINGS

These objects, features and advantages of the invention will be disclosed in detail in the following nonlimiting description of particular embodiments given with reference to the appended figures, in which.

DETAILED DESCRIPTION OF PARTICULAR EMBODIMENTS

To simplify the description below, the longitudinal direction will be used by definition with reference to the length of a wristlet or a wristlet strand. This definition will be extended to an adjustment device and to a clasp on their own, when considering the longitudinal direction of a wristlet strand which will be connected to said adjustment device or to said clasp.

Additionally, the adjective "upper" will be used by definition to denote a surface or any part intended to remain oriented away from a user's wrist when the wristlet is worn. For example, the upper surface of a cover of the clasp will be the surface visible to the user when the clasp is closed on the wrist, away from the hidden surface oriented toward the wrist.

The vertical direction will be defined as a direction perpendicular to the longitudinal direction, oriented from the region intended to come in contact with a user's wrist toward the region on the opposite side. Therefore, this direction will be for example perpendicular or substantially perpendicular to an upper surface of a cover, as will become apparent from the following description.

Lastly, the transverse direction will be defined as the direction perpendicular to the two directions, longitudinal and vertical.

For the sake of simplicity, the same references will be used to denote the same components or similar, or even equivalent components in the two embodiments that will be described.

A device for adjusting the length of a wristlet according to a first embodiment of the invention will now be described, with reference to FIGS. 1 to 9.

Figure 1:
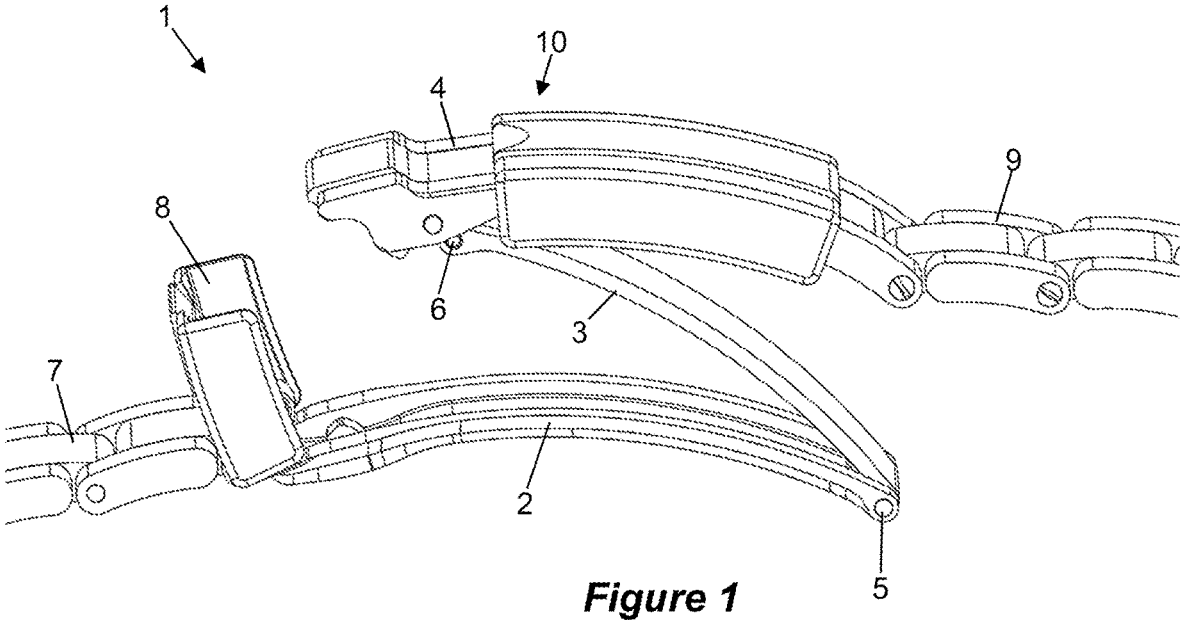
FIG. 1 shows a perspective view of a clasp incorporating a device for adjusting the length of a wristlet according to a first embodiment of the invention.

According to this embodiment, the device for adjusting the length of a wristlet is fitted within a clasp 1, which comprises two blades 2, 3 articulated together. To that end, the second blade 3 is articulated to the first blade 2 and to a first part 4 of a cover 10 at its two respective ends, via a first rotary pin 5 and a second rotary pin 6, respectively. The first blade 2 comprises a device for fixing to a first wristlet strand 7 and to a second part of the cover 8, which are arranged at its end opposite its connection to the second blade 3. The cover 10 comprises a device for adjusting the length of a wristlet, which will be described in detail below. In a known way, the clasp 1 can occupy a closed configuration, in which the two blades are folded together in a superposed manner, locked in this position, in particular via the cover, and in which the wristlet is worn by a user, and an open configuration, in which the blades are deployed, so as to be able to remove the wristlet from a wrist. FIG. 1 shows the clasp in a semi-deployed intermediate position.

Figure 2:
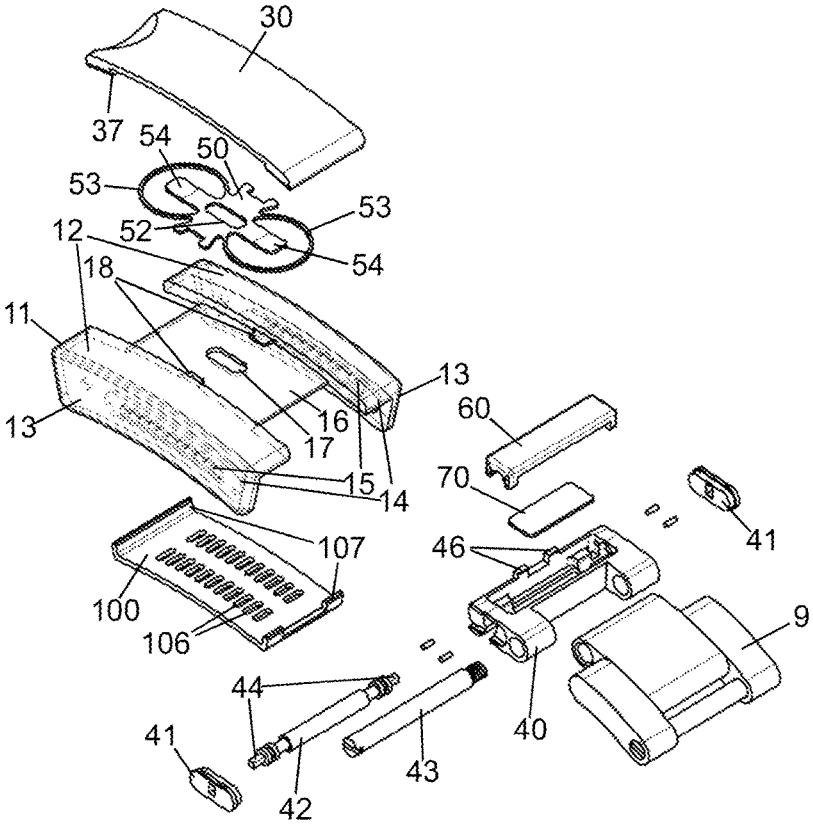
FIG. 2 shows an exploded perspective view of the cover of the clasp incorporating the device for adjusting the length of a wristlet according to the first embodiment of the invention.

FIG. 2 shows the device for adjusting the length of a wristlet according to this first embodiment more specifically, in an exploded perspective view. This adjustment device is more specifically fitted within the cover 10 of the clasp 1.

The cover 10 comprises a main body 11 comprising two lateral parts that are symmetrical with respect to a vertical longitudinal median plane. Each lateral part comprises an upper surface part 12 and a lateral wall 13 substantially perpendicular to the upper surface part 12. A longitudinal groove 14 is arranged in the inner surface of each lateral wall 13. Indexing and locking elements 15 are additionally arranged in these grooves 14, in the form of a toothset, advantageously with a square cross section. This toothset extends in a vertical longitudinal plane. An intermediate base 16 connects the two lateral parts of the cover 10, at an intermediate or substantially intermediate height. It is in the form of a transverse plate comprising a central opening 17.

The device for adjusting the length of a wristlet comprises an actuating device 30 connected to an adjusting link element 40 via a first kinematic connection.

The actuating device 30 is in the form of a surface movable in the longitudinal direction in relation to the cover 10. This surface is arranged at the upper surface of the cover 10 to supplement it, by supplementing the upper surface parts 12, and thus forming a substantially continuous surface with a similar appearance to that of other known clasps from the prior art.

The adjusting link element 40 comprises two lateral shoes 41 positioned respectively within each longitudinal groove 14 of the cover 10 to allow the longitudinal displacement of the adjusting link element 40 in relation to the cover. In this embodiment, these two shoes 41 are arranged respectively at the two ends of a transverse rod 42. The adjusting link element 40 additionally comprises a fixing device for a wristlet strand. In this embodiment, this fixing device is in the form of a pin 43 around which is fitted the first link element of a second wristlet strand 9. The adjusting link element 40 additionally comprises at least one driving detent 46 intended to allow it to be driven longitudinally. In this embodiment, it comprises two substantially vertical driving detents 46. Thus, by way of its longitudinal displacement, the adjusting link element 40 can drive the second wristlet strand 9 in said longitudinal direction, thus bringing about the adjustment of its length and more generally that of the wristlet.

The first kinematic connection makes it possible to connect the actuating device 30 to the adjusting link element 40 so as to make it possible for the actuation of the actuating device 30 to drive the adjusting link element 40. The operation will be described in detail below.

This first kinematic connection comprises a first elastic return element 50, in the form of a first specific spring, fitted between the lower surface of the actuating device 30 and the base 16 of the cover 10. In this embodiment, this first spring is designed to exert multiple elastic return forces of the actuating device 30, for the one part in the longitudinal direction, both ways, and for the other part in the vertical direction. To that end, the first spring is in the form of a spring cut out and encased in its central part by two lugs 18 formed in the base 16 of the cover 10. It comprises a central opening 52 substantially superposed on the central opening 17 in the base 16. The first spring additionally comprises two circular curved flexible parts 53 with a smaller cross section than that of the body of the spring, which perform return functions in the various directions mentioned above. Moreover, this first spring also comprises two other elongate curved flexible parts 54, which likewise contribute to the elastic return of the actuating device 30, in the vertical direction. This first elastic return element 50 makes it possible more particularly to return and hold the actuating device 30 in its rest position, preferably centered and aligned with respect to the base 16, and more generally with respect to the cover 10. The first kinematic connection additionally comprises a rack 100, in the form of a planar plate comprising a detent system in the form of holes 106 aligned evenly in the longitudinal direction, and the two driving detents 46. In this embodiment, the detent system comprises two parallel series of holes 106, disposed at a spacing corresponding to that of the two driving detents 46. At its two longitudinal ends, the rack 100 comprises upwardly inclined portions 107, substantially perpendicular to the rack, which rise toward the actuating device 30 so as to be secured to the corresponding joining portions 37 of the actuating device. This joining has the effect that the rack 100 is movable in the longitudinal direction in a movement linked to that of the actuating device 30.

In this embodiment, the device for adjusting the length of a wristlet additionally comprises a locking device, able to occupy two configurations: a first, locking configuration in which it acts on the adjusting link element 40 by preventing its displacement in relation to the cover 10, and an unlocking configuration in which it releases the adjusting link element 40, which is thus movable in relation to the cover 10 for the purpose of effecting an adjustment. In this embodiment, this locking device is realized via locking detents 44, preferably with a square cross section, arranged respectively at the two ends of the transverse rod 42 of the adjusting link element, and provided to cooperate with the indexing and locking elements 15 arranged in the longitudinal groove 14. The rod 42 is advantageously in the form of a spring bar. In this embodiment, the locking device is actuated by the actuating device 30.

Figure 6:
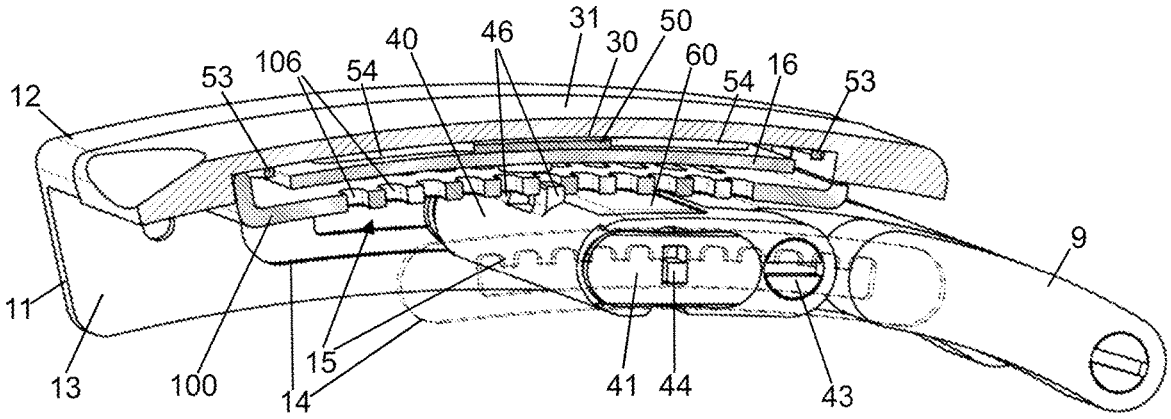

The locking device additionally comprises a second kinematic connection, which connects the actuating device 30 to the locking device, so as to allow the locking or unlocking via the actuation of the actuating device 30. This second kinematic connection comprises an intermediate element 60 and a second elastic return element 70, which is in the form of a planar or substantially planar spring leaf, intended to deform over its width, in particular change in terms of its convexity. The spring bar forming the rod 42 is elastically returned by the spring leaf against the intermediate element 60 so as to position the locking detents 44 between two indexing and locking elements 15, thus positioning the locking device in its locking configuration. The intermediate element 60 is in the form of a push button likewise displaceable in a vertical direction. It is intended to be actuated against the second elastic return element 70 so as to displace the spring bar downward, and thus disengage the locking detents 44 of the indexing and locking elements 15 (FIG. 6).

The operation of this device for adjusting the length of a wristlet will now be explained with reference to FIGS. 3 to 10.

Figure 3:
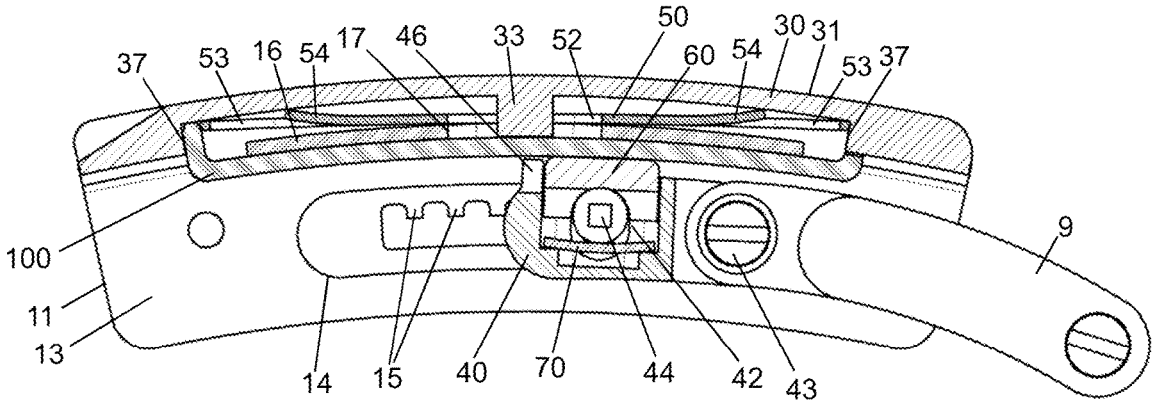
FIG. 3 shows a view in section through a vertical longitudinal plane of the cover of the clasp incorporating the device for adjusting the length of a wristlet at rest according to the first embodiment of the invention.
Figure 4:
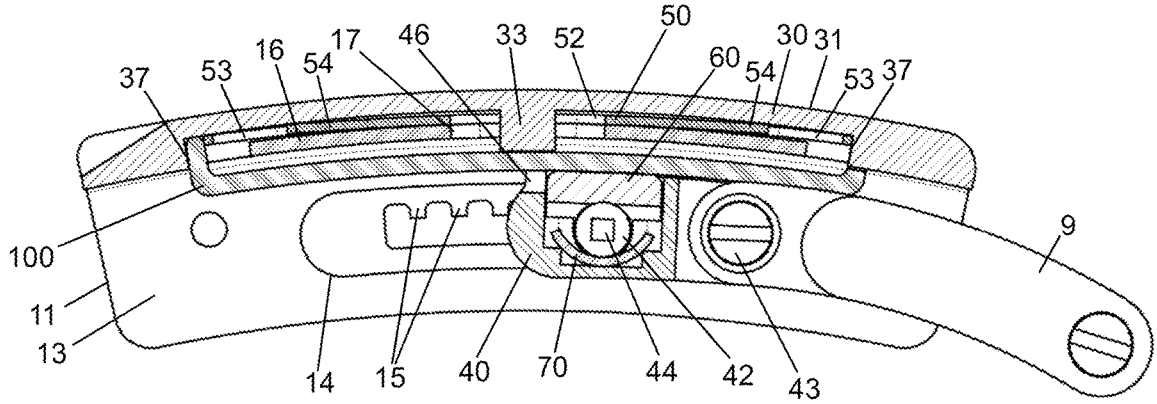
FIG. 4 shows a view in section through a vertical longitudinal plane of the cover of the clasp incorporating the device for adjusting the length of a wristlet, the actuating device of which has been pressed, according to the first embodiment of the invention.

FIGS. 3 and 4 illustrate the device for adjusting the length of a wristlet in section through a vertical longitudinal median plane.

FIG. 3 illustrates the adjusting device in the locked configuration, at rest. The locking detents 44 of the elements are positioned between two indexing and locking elements 15, and the driving detents 46 are disengaged from the holes 106 in the rack 100. FIG. 4 illustrates the adjusting device in the unlocked configuration. It can be seen that the actuating device 30 has been actuated by way of a downward vertical pressure, by simple central contact on its upper surface 31. This pressure has the effect of compressing the first spring forming the first elastic return element 50 against the base 16. This actuation makes the detent system of the rack 100 engage with the driving detents 46. More specifically, these driving detents 46 are positioned inside the holes 106 of the rack 100. At the same time, the rack 100 imparts contact to the intermediate element 60, which similarly imparts the contact to the rod 42, which is displaced downward against the second elastic return element 70, which is deformed. The rod 42 is displaced vertically such that its locking detents 44 come away from the indexing and locking elements 15. Thus, the adjusting link element 40 is no longer locked and is capable of being actuated in longitudinal displacement. The adjusting device is then in the unlocked configuration.

In order to clearly understand the operation of the adjusting device, the implementation of a shortening of the wristlet is explained with reference to FIGS. 5 to 9, which show perspective views in section of various configurations of the adjusting device in the source of such shortening.

Figure 5:
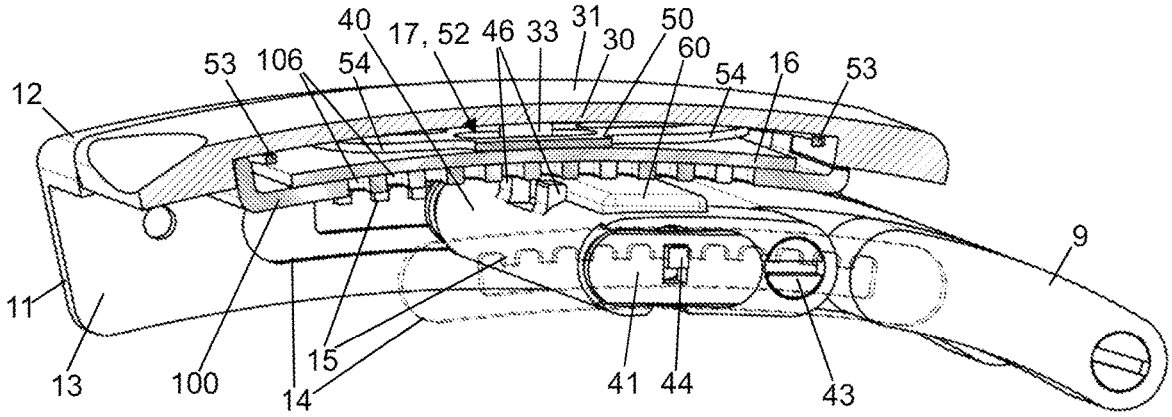
FIGS. 5 to 9 show perspective views in section through a vertical longitudinal plane of the cover of the clasp incorporating the device for adjusting the length of a wristlet according to the first embodiment of the invention, in multiple configurations in the course of an adjustment process.

FIG. 5 illustrates the adjusting device at rest, in the same configuration as that of FIG. 3 explained above. It is thus apparent that the rack 100 is not engaged with the driving detents 46 of the adjusting link element 40. In addition, the locking detents 44 are engaged with the indexing and locking elements 15, locking the adjusting link element 40 in its longitudinal position, and therefore locking the device for adjusting the length of the wristlet. This rest position is stable since the first elastic return element 50 holds the actuating device 30 stably in its rest position.

FIG. 6 illustrates an intermediate adjustment position, in which the device for adjusting the length of a wristlet is in an unlocked configuration, similar to that of the illustration in FIG. 4. In this configuration, the actuating device 30 has been driven downward, as explained in relation with FIG. 4.

Figure 7:
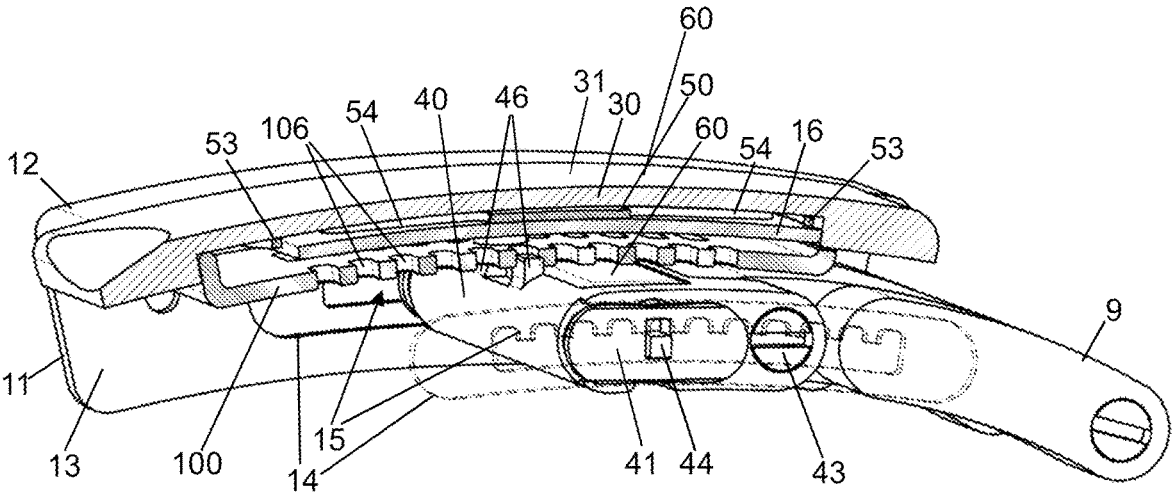

FIG. 7 illustrates the implementation of a length adjustment of the wristlet, in the sense of shortening it. The downward vertical pressure on the actuating device 30 is maintained and the latter is displaced in the longitudinal direction, toward the left in FIG. 7. These actuations drive the adjusting link element 40 in the same longitudinal displacement via the first kinematic connection.

Advantageously, the longitudinal travel of the actuating device 30 is limited by one or more stops. In the embodiment, this travel is defined by the length of the central opening 17 in the base 16, which forms the stops for the displacement of a protuberance 33 of the actuating device 30. This maximum longitudinal travel of the actuating device 30 is advantageously provided so as to be able to slide the adjusting link element 40 by one pitch or by several pitches corresponding to the pitch between two consecutive indexing and locking elements 15. An adjustment of the length of the wristlet can thus correspond to a translatory movement or a succession of translatory movements of the actuating device 30, from its rest position as far as a longitudinal stop. In addition, preferably, the pitch of the rack 100, that is to say the pitch between two holes 106, is identical to the pitch between two indexing and locking elements 15. The arrangement is thus shaped in order that the driving detents 46 always face a hole 106 in the rack 100 when the locking detents 44 face a housing provided for the indexing and locking elements 15.

Figure 8:
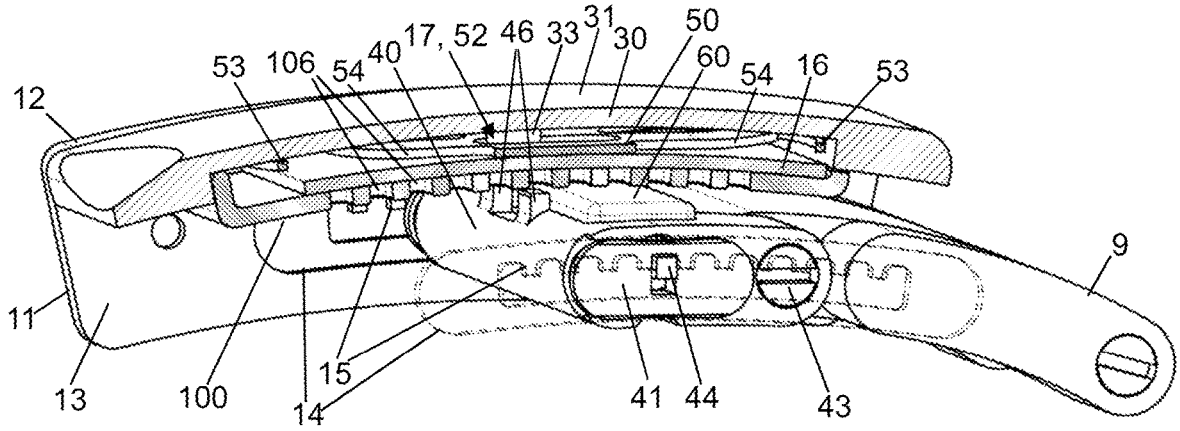

Following a length adjustment, the user relieves the pressure on the actuating device 30. The double elastic return of the two elastic return elements 50, 70 makes the actuating device 30 and the elements of the first and second kinematic connections rise in the vertical direction. The locking detents 44 of the adjusting link element similarly rise, under the effect of the rising of the rod 42, so as to be housed between two indexing and locking elements 15. It should be noted that, in this new configuration, the rack 100 is in its top position, out of the range of the driving detents 46 of the adjusting link element 40. FIG. 8 shows the device in this configuration.

Figure 9:
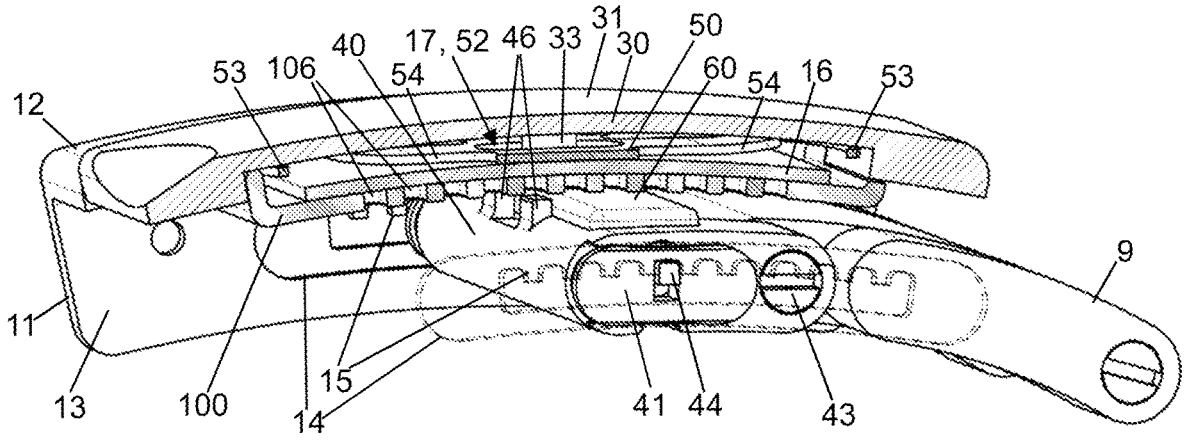

Lastly, the user completely releases the actuating device 30, which goes back to its initial rest position by virtue of the return force applied by the first elastic return element 50, that is to say the first spring. In particular, besides its rise, which was explained in relation with FIG. 8, the actuating device 30 also resumes its rest position in the longitudinal direction, preferably centered, owing to the elastic return in the two directions, vertical and longitudinal, of said first spring. FIG. 9 illustrates this rest configuration.

An adjustment consisting in increasing the useful length of the wristlet can of course be implemented very similarly by displacing the actuating device 30 the other way in the longitudinal direction, that is to say toward the right in FIGS. 5 to 9.

It should be noted that, when the adjusting link element 40 reaches an end position inside the groove 14 of the cover 10, it is in abutment and can be displaced only one way in the longitudinal direction.

It should be noted that it is also possible, with this same construction, to carry out the adjustment of the useful length of the wristlet starting by sliding the actuating device 30 in the longitudinal direction, before exerting a pressure in the vertical direction to unlock the device and engage it with the adjusting link element, and then maintaining this contact until the actuating device returns to its initial position. As a result, the adjusting link element is moved in translation when the actuating device is being returned to its initial position.

In one embodiment variant, the actuating device could be set in motion by a double displacement in the longitudinal and transverse directions, replacing the longitudinal and vertical directions of the embodiment described. The first kinematic connection would be modified by such an implementation.

Generally, in other embodiment variants, the first and second kinematic connections could be different to those shown by way of example.

FIGS. 10 to 17 illustrate a device for adjusting the length of a wristlet according to a second embodiment. This adjusting device is still arranged within a clasp 1, as shown in FIG. 1.

Figure 10:
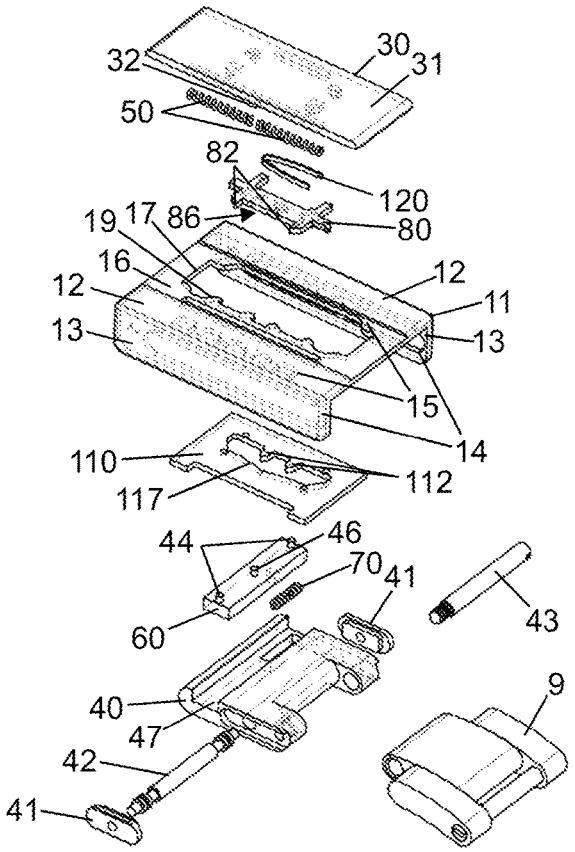
FIG. 10 shows an exploded perspective view of a cover of the clasp incorporating a device for adjusting the length of a wristlet according to a second embodiment of the invention.
Figure 11:
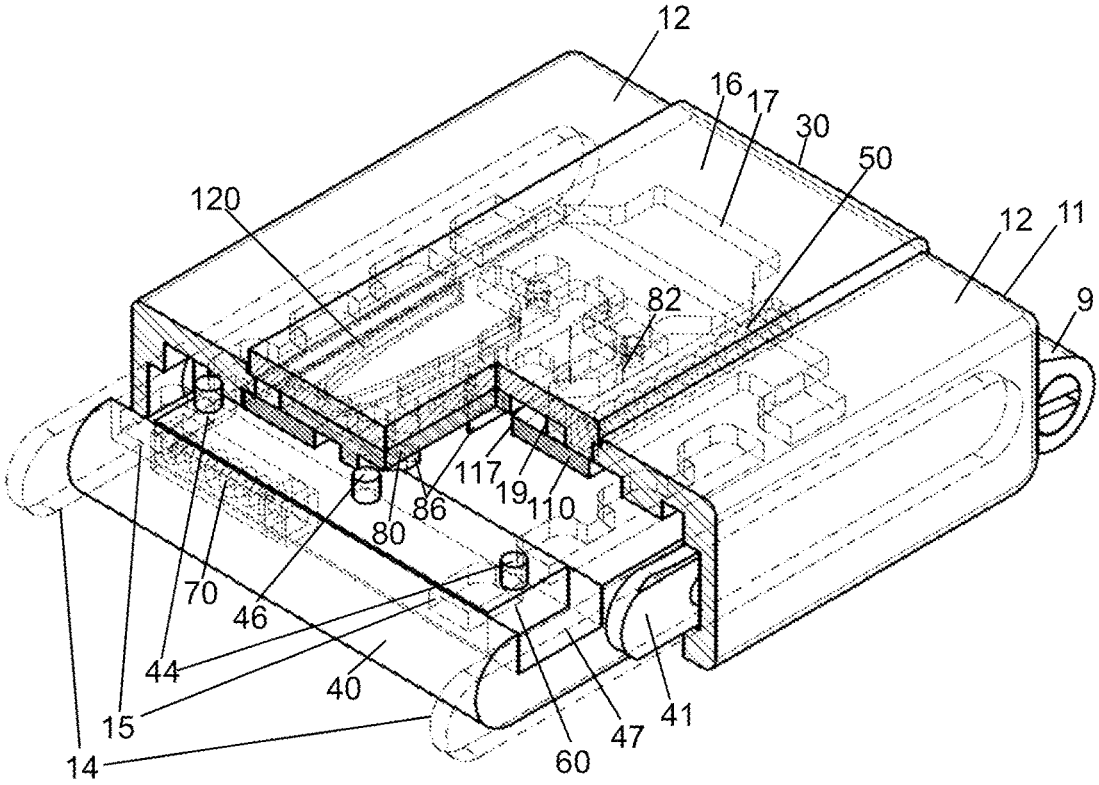
FIG. 11 shows a partial perspective view of the cover of the clasp incorporating the device for adjusting the length of a wristlet according to the second embodiment of the invention.

For the sake of simplification, initially the main differences to the first embodiment will be described in detail, on the basis of FIGS. 10 and 11.

First of all, the actuating device 30 is movable only in the longitudinal direction both ways, and is immovable in the vertical direction and in the transverse direction. It is therefore movable only in a single direction, and not in two directions as in the first embodiment. This device for adjusting the length of a wristlet is thus different from that of the first embodiment in that the displacement of the actuating device 30 in just the longitudinal direction is enough to impart the two functionalities of unlocking an adjusting link element 40 and longitudinally displacing the adjusting link element 40, in order to adjust the length of a wristlet.

The first kinematic connection comprises a first elastic element 50, which comprises two helical springs, arranged in the longitudinal direction within an opening in the base 16, such that a first end is fixed on the base 16 and a second end bears against a lower protuberance 32 of the actuating device 30. This configuration means that the two helical springs exert a return force on the actuating device, in the longitudinal direction both ways, allowing it to return to a rest position centered with respect to the cover 10.

The first kinematic connection additionally comprises a conversion element 80, arranged on the lower surface of the actuating device 30 so as to be secured to this actuating device in the longitudinal direction but movable in the transverse direction, and an element forming a cam surface, which will be referred to simply as first cam surface 110, secured to the actuating device 30 and disposed below the conversion element 80.

The conversion element 80 comprises a guide profile 82 arranged on its flank, intended to cooperate with a second cam surface 19 arranged on the lateral flanks of the central opening 17 in the base 16, in a transverse longitudinal plane, in which the base 16 is arranged. This second cam surface 19 of the base 16 in particular comprises protrusions extending in the transverse direction, allowing the conversion element 80 to be guided in a transverse direction. A third spring 120 acts on the conversion element 80 so as to hold its guide profile 82 against the second cam surface 19 of the base 16 via an elastic spring force in the transverse direction. In this exemplary embodiment, this third spring 120 is in the form of a wire spring bearing against a lug secured to the actuating device 30.

The transverse position of the conversion element 80 is thus defined by the second cam surface 19 of the base 16, depending on the longitudinal position of the actuating device 30 with respect to the base 16 of the main body 11 of the cover.

The conversion element 80 additionally comprises guide elements 86, arranged below its lower surface and intended to cooperate with a driving detent 46. What is different from the first embodiment is that the driving detent 46 is not arranged directly on the adjusting link element, but on the upper surface of an intermediate element 60 arranged within an adjusting link element 40. The locking detents 44 are likewise arranged on this upper surface of said intermediate element. In addition, the first cam surface 110 similarly comprises a profile comprising protrusions 112 arranged in a central opening 117 and able to cooperate with the driving detent 46 of the intermediate element 60.

Lastly, the base 16, the first elastic return element 50, the conversion element 80 and the third spring 120 are interposed between the actuating device 30 and the first cam surface 110. This arrangement makes it possible to keep the assembly of these elements joined together on the cover of the clasp.

The intermediate element 60 is arranged in a housing 47 of the adjusting link element 40, oriented in the transverse direction, so as to be movable in this direction. A second elastic return element 70, which is a helical spring in this embodiment, acts on this intermediate element 60 so as to elastically return it in the transverse direction toward its rest position, thus acting both on the locking detent 44 and on the driving detent 46.

The adjusting link element 40 similarly comprises a transverse rod 42 comprising shoes 41 at its ends, which slide in the longitudinal grooves 14 arranged in the lateral walls 13 of the cover, so as to thus guide the longitudinal displacement of the adjusting link element 40 when the length of a wristlet is being adjusted.

The first kinematic connection thus forms a movement conversion device, which makes it possible to convert a longitudinal translatory movement of the actuating device 30 into a succession of movements within the device for adjusting the length of a wristlet, as will be described in detail below.

The second kinematic connection makes it possible to perform the locking function, via the actuating device 30. By contrast to the first embodiment, the locking function is ensured via indexing and locking elements 15 arranged laterally on the base 16 and not within the longitudinal grooves 14. These indexing and locking elements 15 are arranged in a transverse longitudinal plane, in which the base 16 is arranged. These indexing and locking elements 15 cooperate with one or more locking detents 44, as mentioned above.

FIGS. 12 to 17 show more specifically the operation of the device for adjusting the length of a wristlet according to this second embodiment, in a top view highlighting the components of the kinematic connections so as to clearly illustrate the operation.

Figure 12:
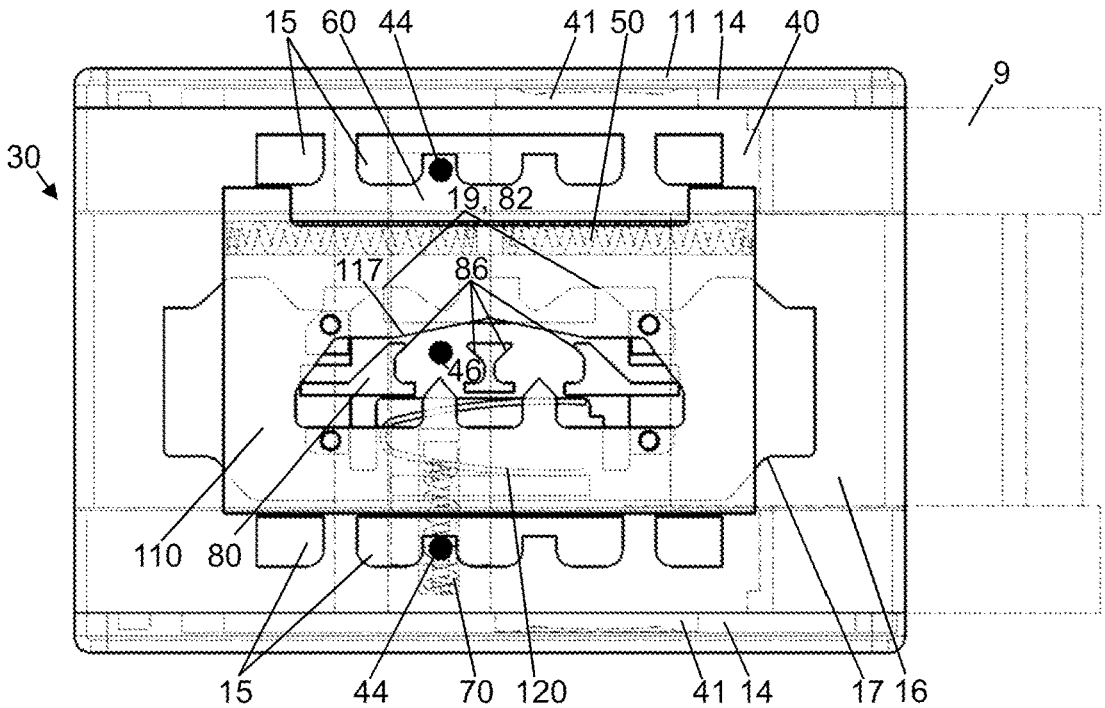
FIGS. 12 to 17 show top views of the cover of the clasp incorporating the device for adjusting the length of a wristlet according to the second embodiment of the invention, in multiple configurations in the course of an adjustment process.

FIG. 12 illustrates the device for adjusting the length of a wristlet at rest, in an intermediate wristlet-length-adjusting position. The driving detent 46 is disconnected from the drive profiles of the first cam surface 110 and the conversion element 80. The intermediate element 60 is additionally in a position in which its locking detents 44 are engaged with the indexing and locking elements 15, such that its positioning is locked.

Figure 13:
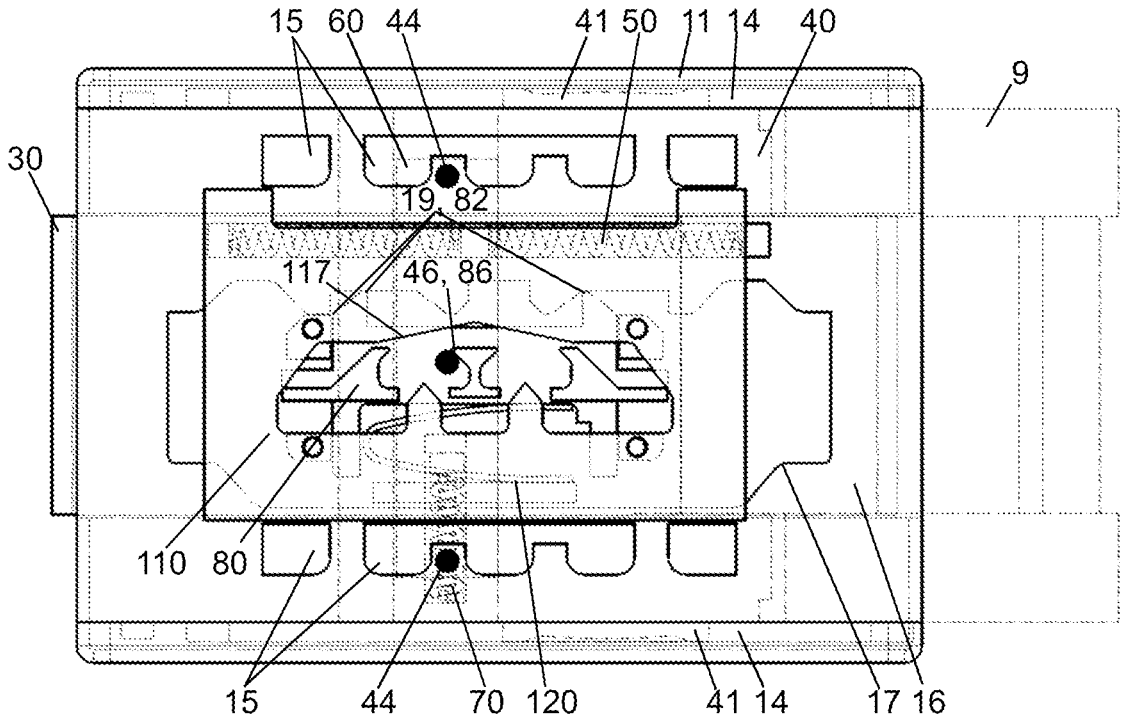

To perform an adjustment of the length of the wristlet, a user actuates the actuating device 30 by displacing it in the longitudinal direction, toward the left in FIGS. 12 to 17 in the example selected. This actuation displaces the conversion element 80 until a guide element 86 engages with the driving detent 46 of the intermediate element 60, as is shown in FIG. 13. At the same time, a guide profile 82 of the conversion element 80 comes into contact with a protrusion of the second cam surface 19 of the base 16. An intermediate configuration is shown in FIG. 13.

Figure 14:
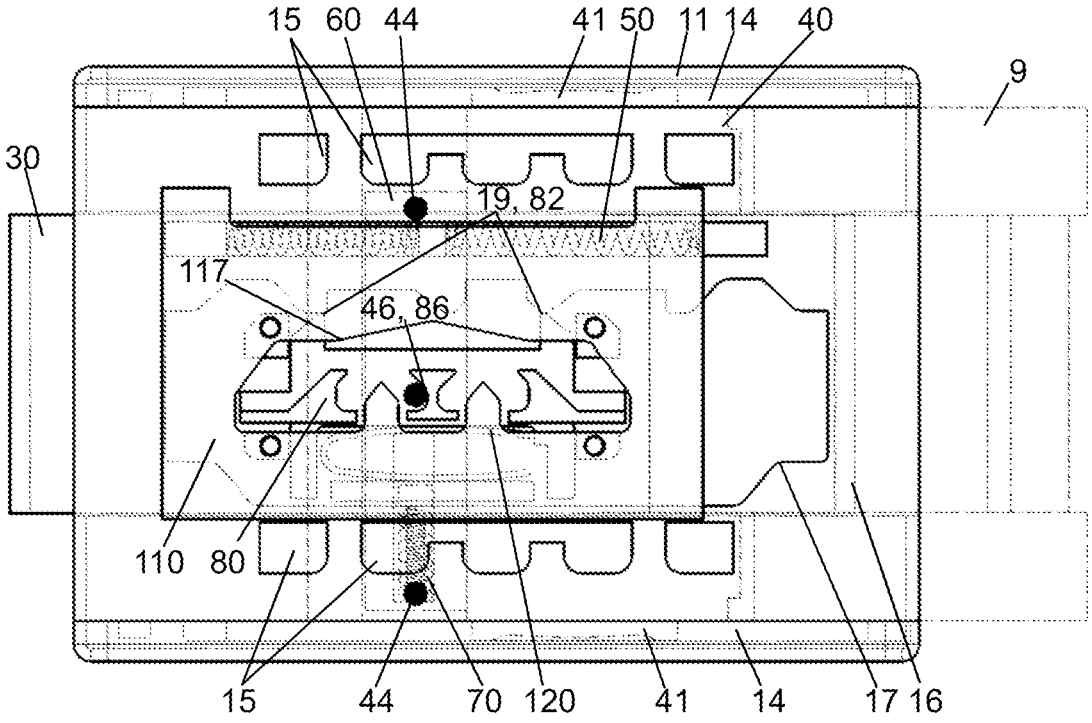

By continuing this movement of the actuating device 30, the cooperation of the guide profile 82 of the conversion element 80 with a protrusion of the second cam surface 19 brings about the transverse displacement of the conversion element 80. In this movement, it drives the intermediate element 60 in the same transverse displacement, owing to the cooperation of its guide element 86 with the driving detent 46 of the intermediate element 60. This displacement of the intermediate element 60 causes its locking detent 44 to come away from the indexing and locking elements 15 arranged laterally in the base 16. This new intermediate configuration is shown in FIG. 14.

Figure 15:
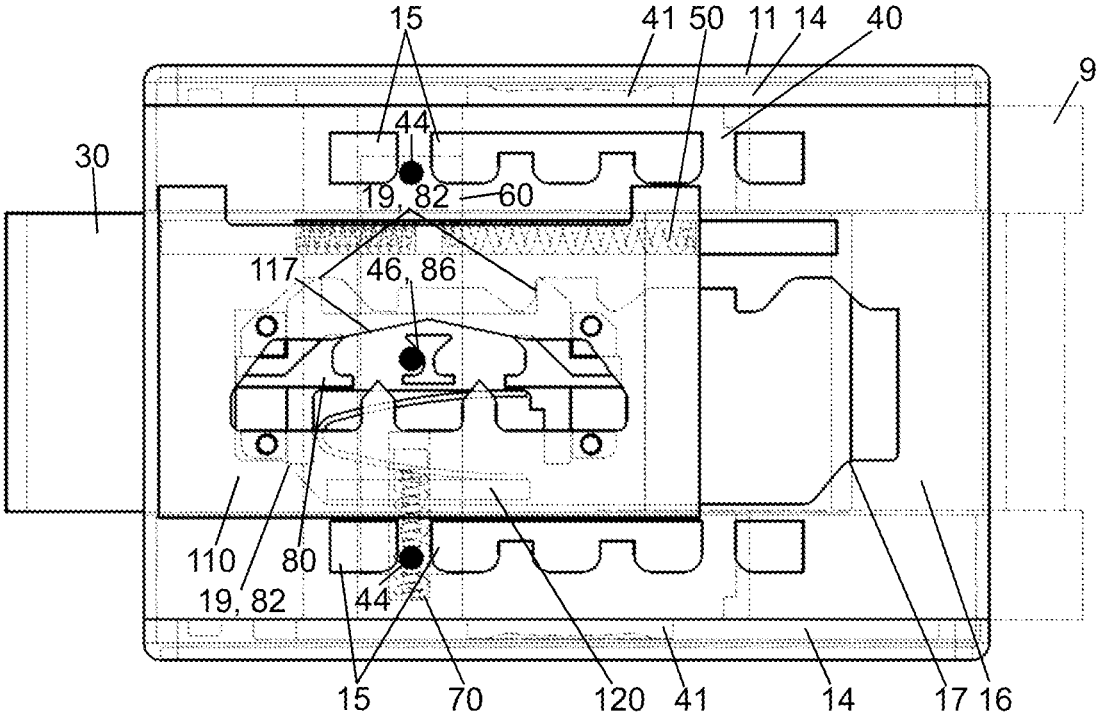

The longitudinal displacement of the actuating device 30 is continued until a stop that predefines its maximum travel depending on the assembly of the arrangement is reached. This travel corresponds to a pitch of the indexing and locking elements 15. At the same time, the guide profile 82 of the conversion element 80 has traversed the protrusion of the second cam surface 19, and the conversion element 80 is transversely displaced on the opposite side by another protrusion of the second cam surface 19 cooperating with the guide profile 82 on the other side of the conversion element 80, and under the effect of the second elastic return element 70 and the third spring 120. It should be noted that the longitudinal stop in this overall displacement is realized between the guide profile 82 of the conversion element 80 and the cam surface 110. This displacement repositions the locking detent 44 in a new detent of the indexing and locking element 15, thereby relocking the intermediate element 60, and indirectly the adjusting link element, in this new position that corresponds to a reduction in the length of the wristlet, more precisely of the second strand of the wristlet. This configuration is illustrated in FIG. 15.

Figure 16:
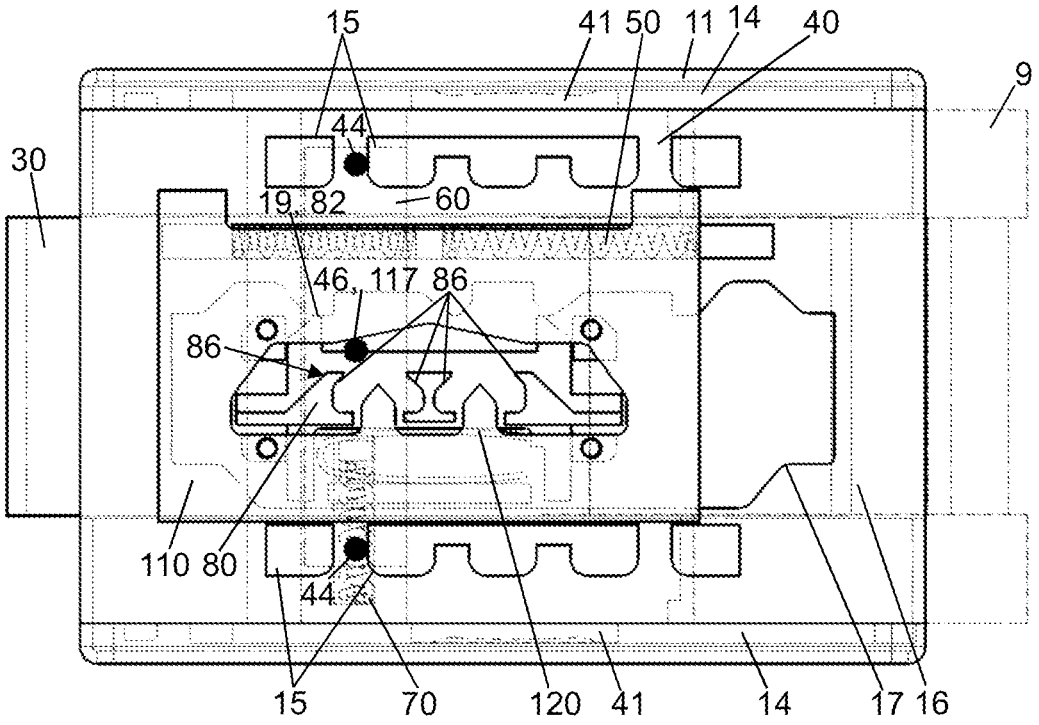

Then, the user releases the actuating device 30, which returns automatically to its rest position, via the elastic return of the first elastic return element 50. FIG. 16 illustrates an intermediate position of the actuating device 30 during its return displacement. In this intermediate configuration, the guide profile 82 of the conversion element 80 comes back into contact with the protrusion of the second cam surface 19. This return guidance drives the driving detent 46 in a transverse direction so as to release the engagement of the driving detent 46 of the intermediate element 60. The movement is continued until the actuating device 30 comes back to its rest position, as shown in FIG. 17.

Figure 17:
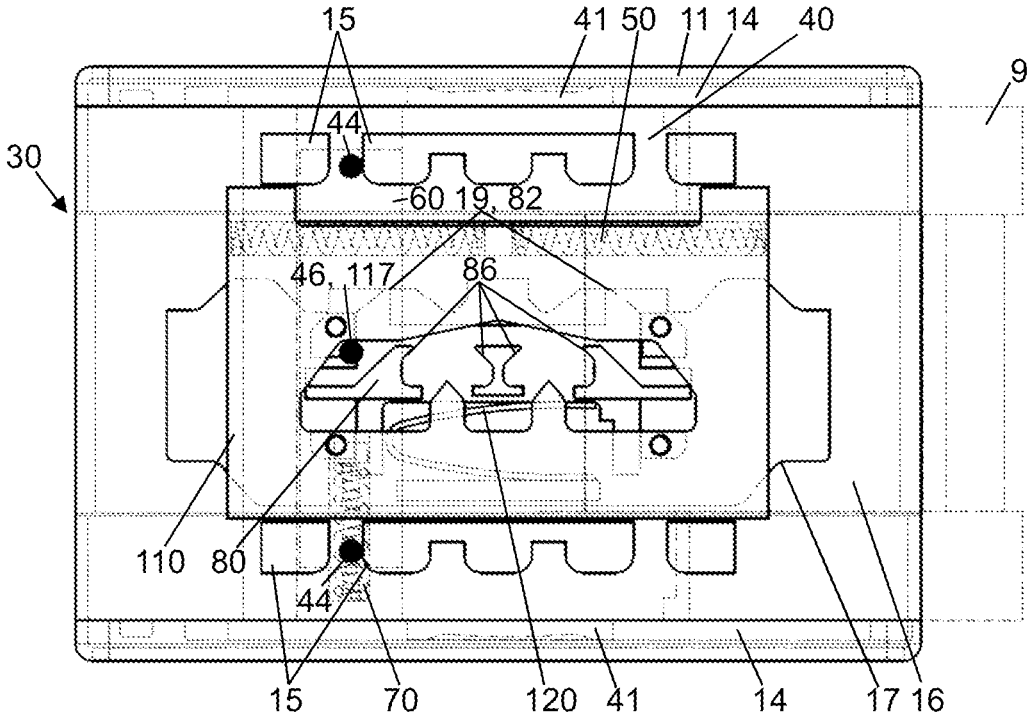

It should be noted that this new position shown in FIG. 17 corresponds to the maximum shortening of the useful length of the wristlet. As a result, if the actuating device is urged again in the sense of shortening, the first kinematic connection simply would not allow the adjusting link element to be driven further.

The lengthening of the wristlet will be obtained in a very similar way, by actuating the actuating device 30 the other way in the longitudinal direction (toward the right in FIGS. 12 to 17).

Of course, the invention is not limited to the two embodiments described. Various embodiment variants can be conceived from these two embodiments.

In an advantageous implementation illustrated, the actuating device is incorporated uniformly and continuously on the upper surface of the cover. It is preferably centered on the upper surface of the cover and/or forms a central portion of the cover, in a rest position. It advantageously extends over the entire length of the cover. This upper surface thus forms a continuous surface of the cover substantially parallel to the upper surface of a wristlet strand that will be fixed to the adjusting link element. Of course, as a variant, the actuating device could take any other form arranged at the upper surface of the cover.

As a variant, it would be possible for the actuating device not to be arranged on the upper surface of the cover, but for example on a lateral surface, its movement remaining in the longitudinal direction and optionally in another direction.

In another embodiment variant, it would be possible for the adjusting device not to comprise any locking device, which is therefore optional. This is because the actuating device and/or the first kinematic connection could be such that it is enough to reduce the risk of accidental modification of the length adjustment, without a locking device. As a variant, the movements of the actuating device could be locked by a safety device. This safety device could be the same as that which prevents unintentional opening of the clasp.

In another variant, the locking device could be actuable by a second actuating device, a locking/unlocking element, separate from the first actuating device, making it possible to perform the length adjustment alone, instead of coinciding with the latter as in the embodiments described. This second actuating device could have imparted to it a different movement to that of the first actuating device, in particular in another direction. In a further variant, the locking device could comprise locking elements of any form, not necessarily a detent system as shown, but also for example a simple friction brake system.

The adjusting device has been described with two or three elastic return elements. A different number of elastic return elements is possible, of course.

In addition, the adjusting device has been described as being incorporated inside a cover of a clasp. As a variant, it could be incorporated in any cover, not necessarily that of a clasp. This cover could take any form, even a very simple one.

The adjusting link element has been described up to now as an element independent of a wristlet, which comprises a fixing device for a wristlet strand, in particular for fixing in an articulated manner. In a variant, this fixing could be different, without degrees of freedom. In a further variant, the adjusting link element could be incorporated entirely in a wristlet strand. It could therefore form a single part with a wristlet strand. It is therefore considered overall that the adjusting link element is designed to be connected to a wristlet strand, to cover all these implementations.

The adjusting device could for example be arranged within a lug spacing of a watch case, a fixing means, an end-link, a wristlet link element or a strand, a case middle or a case bottom. More generally, this adjusting device could be arranged within any element of the watch that contributes directly or indirectly to the constitution or the joining of the wristlet to the watch case.

The invention claimed is:

1. A device for adjusting a length of a wristlet, wherein the device comprises:

a cover;

an adjusting link element designed to be connected to a wristlet strand, the cover having a longitudinal direction corresponding to a direction in which extends a wristlet strand which is to be connected to the adjusting link element, the adjusting link element being mounted so as to be movable relative to the cover at least along the longitudinal direction of the cover, so that a displacement of the adjusting link element relative to the cover along the longitudinal direction of the cover makes it possible to lengthen or shorten a length of a wristlet strand;

an actuating device arranged on the cover so as to be movable relative to the cover at least along the longitudinal direction of the cover, and a first kinematic connection connecting the actuating device and the adjusting link element, so that an actuation of the actuating device at least along the longitudinal direction of the cover is able to bring about a longitudinal displacement of the adjusting link element in relation to the cover, wherein the actuating device is arranged at an upper surface of the cover.

2. The device for adjusting the length of a wristlet as claimed in claim 1, wherein the device comprises a first elastic return element connected to the actuating device, the first elastic return element acting on the actuating device so as to return the actuating device to a rest position after the actuating device has been actuated by a user.

3. The device for adjusting the length of a wristlet as claimed in claim 1, wherein the device further comprises:

a locking device, able to occupy two configurations: a first, locking configuration in which the locking device acts on the adjusting link element by preventing a displacement of the adjusting link element relative to the cover, and an unlocking configuration in which the locking device releases the adjusting link element which is movable relative to the cover;

a locking/unlocking element actuable by a user and connected to the locking device via a second kinematic connection, so as to be able to switch from the locking configuration of the locking device to the unlocking configuration of the locking device by actuating the locking/unlocking element.

4. The device for adjusting the length of a wristlet as claimed in claim 3, wherein the locking/unlocking element and the actuating device are one and a same component, so that at least one actuation of the actuating device causes a switch from the locking configuration to the unlocking configuration of the locking device and the longitudinal displacement of the adjusting link element.

5. The device for adjusting the length of a wristlet as claimed in claim 4, wherein the actuating device is movable relative to the cover in at least a second direction different than the longitudinal direction, the first kinematic connection between the actuating device and the adjusting link element being so that the actuation of the actuating device in the second direction causes the switch from the locking configuration to the unlocking configuration of the locking device.

6. The device for adjusting the length of a wristlet as claimed in claim 4, wherein the first kinematic connection between the actuating device and the adjusting link element is so that an actuation of the actuating device in the longitudinal direction causes the switch from the locking configuration to the unlocking configuration of the locking device.

7. The device for adjusting the length of a wristlet as claimed in claim 3, wherein the device comprises a second elastic return element, connected to the locking device and acting on the locking device so as to bring the locking device back into a locking configuration.

8. The device for adjusting the length of a wristlet as claimed in claim 3, wherein the actuating device is movable relative to the cover in both ways in the longitudinal direction, and wherein the first kinematic connection connecting the actuating device and the adjusting link element is so that actuation of the actuating device a first way in the longitudinal direction in relation to the cover causes a longitudinal displacement in the first way of the adjusting link element relative to the cover when the locking device is in the unlocking configuration and so that actuation of the actuating device a second way counter to the first way in the longitudinal direction in relation to the cover causes a longitudinal displacement in the second way of the adjusting link element relative to the cover when the locking device is in the unlocking configuration.

9. The device for adjusting the length of a wristlet as claimed in claim 3, wherein the locking device comprises a detent system in at least one lateral wall or in a base of the cover and a locking detent connected to the adjusting link element.

10. The device for adjusting the length of a wristlet as claimed in claim 9, wherein the device comprises at least one stop limiting the displacement in a longitudinal direction of the actuating device, so that the longitudinal displacement of the actuating device from a rest position thereof to position thereof against the stop causes a displacement of the actuating device along a length representing a multiple of a distance between two teeth of the detent system, so that the adjusting link element can occupy a finite number of positions and is displaced in increments upon each actuation of the actuating device.

11. The device for adjusting the length of a wristlet as claimed in claim 1, wherein the first kinematic connection comprises at least one rack and at least one driving detent, so that actuation of the actuating device causes the at least one driving detent to cooperate with the rack so as to displace the adjusting link element.

12. A clasp, comprising the device for adjusting the length of a wristlet as claimed in claim 1.

13. A wristlet, comprising the clasp as claimed in claim 12.

14. A timepiece, comprising the wristlet as claimed in claim 13.

15. A deployment clasp for a wristlet, comprising the device for adjusting the length of a wristlet as claimed in claim 1.

16. The device for adjusting the length of a wristlet as claimed in claim 1, wherein the actuating device forms a central portion of the cover.

17. The device for adjusting the length of a wristlet as claimed in claim 1, wherein the actuating device comprises an upper surface arranged in continuity with the upper surface of the cover, at least in a rest position, forming a continuous surface of the cover substantially parallel to the upper surface of a wristlet strand which is to be connected to the adjusting link element.

18. The device for adjusting the length of a wristlet as claimed in claim 5, wherein the second direction is a direction perpendicular to the surface of a wristlet strand that is to be connected to the adjusting link element or perpendicular to the longitudinal direction of a wristlet strand that is to be connected to the adjusting link element.

19. A device for adjusting a length of a wristlet, wherein the device comprises:

a cover;

an adjusting link element designed to be connected to a wristlet strand, the adjusting link element being mounted so as to be movable relative to the cover in a longitudinal direction in which extends a wristlet strand which is to be connected to the adjusting link element, so that a displacement of the adjusting link element relative to the cover makes it possible to lengthen or shorten a length of a wristlet strand;

an actuating device arranged on the cover so as to be movable relative to the cover in at least the longitudinal direction;

a first kinematic connection connecting the actuating device and the adjusting link element, so that an actuation of the actuating device in at least the longitudinal direction relative to the cover is able to bring about a longitudinal displacement of the adjusting link element in relation to the cover, wherein the actuating device is arranged at an upper surface of the cover, wherein the actuating device extends over an entire length of the cover.

* * * * *